US009750347B2

(12) United States Patent
Nuckolls

(10) Patent No.: US 9,750,347 B2
(45) Date of Patent: Sep. 5, 2017

(54) PRESSURE RELEASE SLIDE LATCH MECHANISM

(71) Applicant: Hardware Resources, Inc., Bossier City, LA (US)

(72) Inventor: Grant Nuckolls, Bossier City, LA (US)

(73) Assignee: HARDWARE RESOURCES, INC., Bossier City, LA (US)

( * ) Notice: Subject to any disclaimer, the term of this patent is extended or adjusted under 35 U.S.C. 154(b) by 12 days.

(21) Appl. No.: 14/281,643

(22) Filed: May 19, 2014

(65) Prior Publication Data

US 2014/0312755 A1 Oct. 23, 2014

Related U.S. Application Data

(63) Continuation-in-part of application No. 13/460,197, filed on Apr. 30, 2012, now abandoned.

(51) Int. Cl.

| | |
|---|---|
| ***A47B 88/04*** | (2006.01) |
| ***A47B 88/463*** | (2017.01) |
| ***A47B 88/453*** | (2017.01) |
| ***A47B 88/46*** | (2017.01) |
| ***A47B 88/40*** | (2017.01) |

(52) U.S. Cl.

CPC ..... *A47B 88/463* (2017.01); *A47B 88/40* (2017.01); *A47B 88/453* (2017.01); *A47B 88/46* (2017.01); *Y10T 29/49* (2015.01); *Y10T 29/49764* (2015.01)

(58) Field of Classification Search

CPC ..... A47B 88/047; A47B 88/0477; A47B 88/0481; A47B 2088/0474; A47B 88/40; A47B 88/453; A47B 88/46

See application file for complete search history.

(56) References Cited

U.S. PATENT DOCUMENTS

| | | | |
|---|---|---|---|
| 3,203,749 | A | 8/1965 | Bullock et al. |
| 3,371,968 | A | 3/1968 | Loake |
| 3,801,166 | A | 4/1974 | York |

(Continued)

FOREIGN PATENT DOCUMENTS

| | | |
|---|---|---|
| CA | 2573939 | 11/2007 |
| CN | 2569641 | 9/2003 |

(Continued)

OTHER PUBLICATIONS

Espacenet, "Sliding Rail Assembly Auto Opening Mechanism for Drawer," MY143065, Min Lu Chun, Feb. 28, 2011.

*Primary Examiner* — Daniel J Troy
*Assistant Examiner* — Ryan A Doyle
(74) *Attorney, Agent, or Firm* — Schultz & Associates, P.C.

(57) ABSTRACT

A pressure release slide latch mechanism for a drawer slide assembly comprises an outer slide, an intermediate slide mounted in the outer slide, and an inner slide mounted in the intermediate slide, a channel plate having a track portion and a guide block attached to the outer slide and a carriage slidingly engaged and biased along the track portion. A pin of a follower pivotally attached to the inner slide engages the guide block to releasably maintain the drawer slide assembly in a closed position and releases upon an inward force applied to the drawer slide assembly. A set of chamfers is formed on the pressure release slide latch mechanism to prevent binding of the drawer slide assembly.

8 Claims, 18 Drawing Sheets

(56) References Cited

U.S. PATENT DOCUMENTS

| | | | | |
|---|---|---|---|---|
| 3,954,315 | A | 5/1976 | Sanden | |
| 4,370,007 | A | 1/1983 | Fler | |
| 4,469,384 | A | 9/1984 | Fler et al. | |
| 4,494,806 | A | 1/1985 | Williams et al. | |
| 4,596,427 | A | 6/1986 | Pflugfelder | |
| RE32,456 | E | 7/1987 | Ishii | |
| 4,696,582 | A | 9/1987 | Kasten | |
| 4,712,845 | A | 12/1987 | Nicol | |
| 4,988,214 | A | 1/1991 | Clement | |
| 5,004,306 | A | 4/1991 | Oshida | |
| 5,230,551 | A | 7/1993 | Kramer | |
| 5,426,885 | A | 6/1995 | Wittman | |
| 5,484,197 | A | 1/1996 | Hansen et al. | |
| 5,507,571 | A | 4/1996 | Hoffman | |
| 5,634,703 | A | 6/1997 | Vonier | |
| 5,722,750 | A * | 3/1998 | Chu | A47B 88/10 312/334.11 |
| 5,757,109 | A | 5/1998 | Parvin | |
| 5,775,788 | A | 7/1998 | Sasse et al. | |
| 5,975,662 | A | 11/1999 | Weber | |
| 6,155,661 | A * | 12/2000 | O'Neil | A47B 88/047 312/333 |
| 6,220,683 | B1 * | 4/2001 | Chu | A47B 88/14 312/334.11 |
| 6,238,031 | B1 | 5/2001 | Weng | |
| 6,244,678 | B1 | 6/2001 | Dopp et al. | |
| 6,254,205 | B1 | 7/2001 | Wright et al. | |
| 6,350,001 | B1 | 2/2002 | Chu | |
| 6,450,600 | B1 | 9/2002 | Chen et al. | |
| 6,685,288 | B1 | 2/2004 | MacMillan | |
| 6,899,408 | B2 | 5/2005 | Chen et al. | |
| 6,938,967 | B2 | 9/2005 | Dubon et al. | |
| 7,083,243 | B2 | 8/2006 | Lee | |
| 7,104,691 | B2 | 9/2006 | Chi | |
| 7,111,913 | B2 | 9/2006 | Dubon | |
| 7,320,507 | B2 | 1/2008 | White et al. | |
| 7,347,515 | B1 | 3/2008 | Lu | |
| 7,347,516 | B2 | 3/2008 | Hay | |
| 7,364,245 | B2 | 4/2008 | Dubon | |
| 7,374,261 | B1 * | 5/2008 | Wang | A47B 88/0477 312/319.1 |
| 7,404,611 | B1 | 7/2008 | Que | |
| 7,441,848 | B2 | 10/2008 | Chen et al. | |
| 7,458,651 | B1 | 12/2008 | Radke et al. | |
| 7,520,577 | B2 | 4/2009 | Chen et al. | |
| 7,552,982 | B2 | 6/2009 | Beaudoin | |
| 7,641,296 | B2 | 1/2010 | Le | |
| 7,802,856 | B2 | 9/2010 | Hashemi et al. | |
| 7,854,485 | B2 | 12/2010 | Berger | |
| 7,857,403 | B2 | 12/2010 | Chen et al. | |
| 8,029,080 | B2 | 10/2011 | MacElveen | |
| 2003/0117048 | A1 | 6/2003 | Mueller | |
| 2003/0122460 | A1 | 7/2003 | Chang | |
| 2004/0197035 | A1 | 10/2004 | Doornbos et al. | |
| 2004/0201338 | A1 | 10/2004 | Mouw | |
| 2005/0248247 | A1 | 11/2005 | Huang | |
| 2007/0090735 | A1 * | 4/2007 | Hashemi | A47B 88/0477 312/334.46 |
| 2011/0069914 | A1 | 3/2011 | Hashemi et al. | |

FOREIGN PATENT DOCUMENTS

| | | | |
|---|---|---|---|
| CN | 2764235 | 3/2006 | |
| DE | 202004011916 | 12/2004 | |
| DE | 202005003187 | 7/2005 | |
| DE | 102004037120 | 3/2006 | |
| DE | WO 2007122066 A1 * | 11/2007 | A47B 88/0481 |
| DE | 102008004545 | 7/2009 | |
| DE | 202009002715 | 8/2010 | |
| DE | 202011000362 | 9/2011 | |
| EP | 0743032 | 11/1996 | |
| EP | 0766939 | 4/1997 | |
| EP | 1634025 | 3/2006 | |
| EP | 1716781 | 11/2006 | |
| EP | 1925240 | 5/2008 | |
| EP | 2007246 | 12/2008 | |
| EP | 2201863 | 6/2010 | |
| GB | 2416295 | 7/2005 | |
| GB | 2434306 | 7/2007 | |
| JP | 60215319 | 10/1985 | |
| JP | 08-117044 | 5/1996 | |
| JP | 2003204832 | 7/2003 | |
| JP | 2004065701 | 4/2004 | |
| JP | 2006102294 | 4/2006 | |
| JP | 2007089680 | 4/2007 | |
| JP | 2007190310 | 8/2007 | |
| TW | 281524 | 12/2005 | |
| TW | 394046 | 12/2010 | |
| TW | 396049 | 1/2011 | |
| WO | 2004023933 | 3/2004 | |
| WO | 2007050737 | 5/2007 | |
| WO | 2010009780 | 1/2010 | |
| WO | 2010066393 | 6/2010 | |
| WO | 2010123550 | 10/2010 | |

* cited by examiner

PRESSURE RELEASE SLIDE LATCH MECHANISM

CROSS REFERENCE TO RELATED APPLICATION

This application is a continuation in part of U.S. application Ser. No. 13/460,197 filed Apr. 30, 2012. The patent application identified above is incorporated herein by reference in its entirety to provide continuity of disclosure.

FIELD OF THE INVENTION

The present invention relates to slide assemblies for mounting drawers in cabinetry. In particular, the invention relates to extension ball bearing slide assemblies with a durable pressure release slide latch mechanism which retains the slide assembly in a closed position and opens upon exerting an inward force to release and open the slide assembly.

BACKGROUND OF THE INVENTION

Drawer slide assemblies mounted to cabinets and drawers for slidably opening and closing a drawer are well known in the art. The assemblies typically include at least two slide rails that are telescopically mounted within one another to extend and retract. The typical assembly includes an outside rail, which is mounted to the cabinet and an inside rail, which is mounted to the drawer. Ball bearing assemblies are usually mounted between the rails to reduce the friction between the rails. This reduction in friction between the rails allows the drawer to easily open and close. As a result, the drawer can unintentionally open causing injury and/or causing the contents of the drawer to escape. For example, a child can easily pull open a drawer and strike a body part against the open drawer causing injury. In another example, a drawer mounted to a cabinet installed in a recreational vehicle can unintentionally open during movement causing the contents of the drawer to dislodge and escape.

The prior art has attempted to solve these problems. For example, U.S. Pat. No. 7,083,243 to Lee discloses a self-closing and opening-preventing device for slide rails. The device includes a housing mounted to the inside of a fixing rail attached to a cabinet. The housing has a central long pin guiding groove to accept a pin attached to a moveable rail. A cam slider moves within the housing and a spring is attached to the rear of the housing and to the cam slider. Engaging jaws mounted on the cam slider can be locked in the engaging holes. The engaging jaws are configured to receive an actuating pin fixed to a moveable rail to lock the opening-preventing device.

However, the device requires numerous parts that easily wear leading to failure of the device. Specifically, the spring remains in a stretched position until the engaging jaws engage the actuating pin. This constant tension leads to fatigue and premature failure. Further, the pins of the cam slider on which the engaging jaws are mounted are thin which leads to the severance of the pins from the cam slider.

U.S. Pat. No. 7,104,691 to Chi discloses a self-moving mechanism to keep a drawer slide in a closed position. The mechanism includes a housing mounted to a first slide rail, an actuator under spring compression moveable within the housing wherein the movement of the actuator is guided by a series of slots, and an angled slit formed in the web of a second slide rail telescopically mounted to the first slide. As the second slide retracts, the angled slit engages a pin attached to the actuator and the actuator urges the pin and the second slide into a retracted position. Flexible tines adjacent a longitudinal slot keeps the pin of the actuator, and thereby the second slide, in a retracted position. The mechanism disclosed in Chi requires thin tines cut into a wall in the housing to keep the second slide in a retracted position, which leads to fatigue and ultimately failure. The premature failure renders the entire mechanism useless. Further, Chi does not provide a push to open feature.

U.S. Pat. No. 7,854,485 to Berger discloses a closing and opening device for drawers. A latch housing is attached to an outer rail and a moveable catch component slidably moves within the latch housing. The moveable catch component is moved by a dog attached to a running rail slidingly engaged with the outer rail and attached to a drawer. The moveable catch component is biased by a coupling rod adjacent to the moveable catch component and under spring compression. The coupling rod has a ball head to frictionally engage a receiver of the moveable catch component. Opposite the moveable catch component is a lever hingedly connected to the coupling rod. The lever has a projection that guides the lever along a cam path.

However, the device in Berger requires the ball head to frictionally engage the receiver of the moveable catch component each and every time the drawer is closed. Once the projection and lever is released from the closed position the ball head remains frictionally engaged with the moveable catch component requiring further pulling force to release the drawer. This constant frictional engagement between the ball head and the receiver leads to premature wear and ultimately failure, which results in rendering the opening and closing device useless.

The prior art fails to disclose or suggest a pressure release slide latch mechanism with a push to open feature that will not result in premature failure. Therefore, there is a need for a pressure release slide latch mechanism of durable construction allowing for a reliable and easy push to open feature with fewer parts. Anticipated applications of the invention include, but are not limited to environments where no drawer knobs or pull handles are desired, environments where safety is a concern such, and/or environments where sanitary conditions are a concern. For example, hospitals may use the invention to reduce the collection of bacteria on handles or knobs and daycare centers where the invention may be used reduce injury from striking protruding hardware and from the unintentional opening of a drawer.

The prior art also fails to disclose or suggest a method of modifying mechanisms such as pressure slide latch mechanisms to operate in cabinet carcasses which are not square.

SUMMARY

In a preferred embodiment, a pressure release slide latch mechanism for a drawer slide assembly comprises an outer slide member, an intermediate slide member telescopically mounted to the outer slide member, and an inner slide member telescopically mounted to the intermediate slide member. The preferred embodiment further comprises a channel plate having a track portion and a guide block attached to the outer slide member and a carriage slidingly engaged with the track portion of the channel plate. Two tension springs are attached to an end of the track portion and the carriage to bias the carriage. The guide block has a plurality of channels and a latch member to receive a pin of a follower pivotally attached to the inner slide member to releasably maintain the inner slide member and the intermediate slide member in a locked position with respect to the outer slide member. The pivotal movement of the follower is limited by a guide post connected to the follower and the engagement of the guide post with the inner slide member.

In use, to close the drawer slide assembly using the pressure release slide latch mechanism the intermediate slide member and the inner slide member approach a retracted position with respect to the outer slide member, the intermediate slide member engages the carriage and urges the carriage against the tension of the springs. Simultaneously, the inner slide member engages a set of bumpers on the carriage while the pin of the follower slidingly engages a ramp of the guide block and redirecting surfaces to guide the pin through an inlet channel is received into a first positioning recess. Under spring bias from the springs attached to the channel plate and the carriage, the carriage extends the intermediate slide member and the inner slide member causing the pin to abut the latch member to retain the inner slide member and the intermediate slide member in a locked position with respect to the outer slide member.

To release the inner slide member and the intermediate slide member from the outer slide member, the inner slide member is urged against the tension of the springs to release the pin from the latch member and the pin is positioned by a redirecting surface into a second positioning recess. Under spring tension, the pin is allowed to travel through an outlet channel and engages redirecting surfaces to direct the pin out of the ramp to release the pin and thereby release the inner slide member and the intermediate slide member allowing the inner slide member and the intermediate slide member to telescopically extend with respect to the outer slide member.

In another embodiment, a method for modifying a drawer slide assembly is disclosed. In this embodiment, the drawer slide is misaligned and includes a set of interference points that are prone to binding. The method includes the steps of identifying the set of interference points in the drawer slide assembly, enabling a relative part movement for a set of parts at an interference point of the set of interference points, determining a chamfer for the set of parts at the interference point, and modifying the set of parts with the chamfer to create a set of modified parts.

BRIEF DESCRIPTION OF THE DRAWINGS

The disclosed embodiments will be described with reference to the accompanying drawings. Like pieces in different drawings carry the same number.

DETAILED DESCRIPTION

Figure 1A:
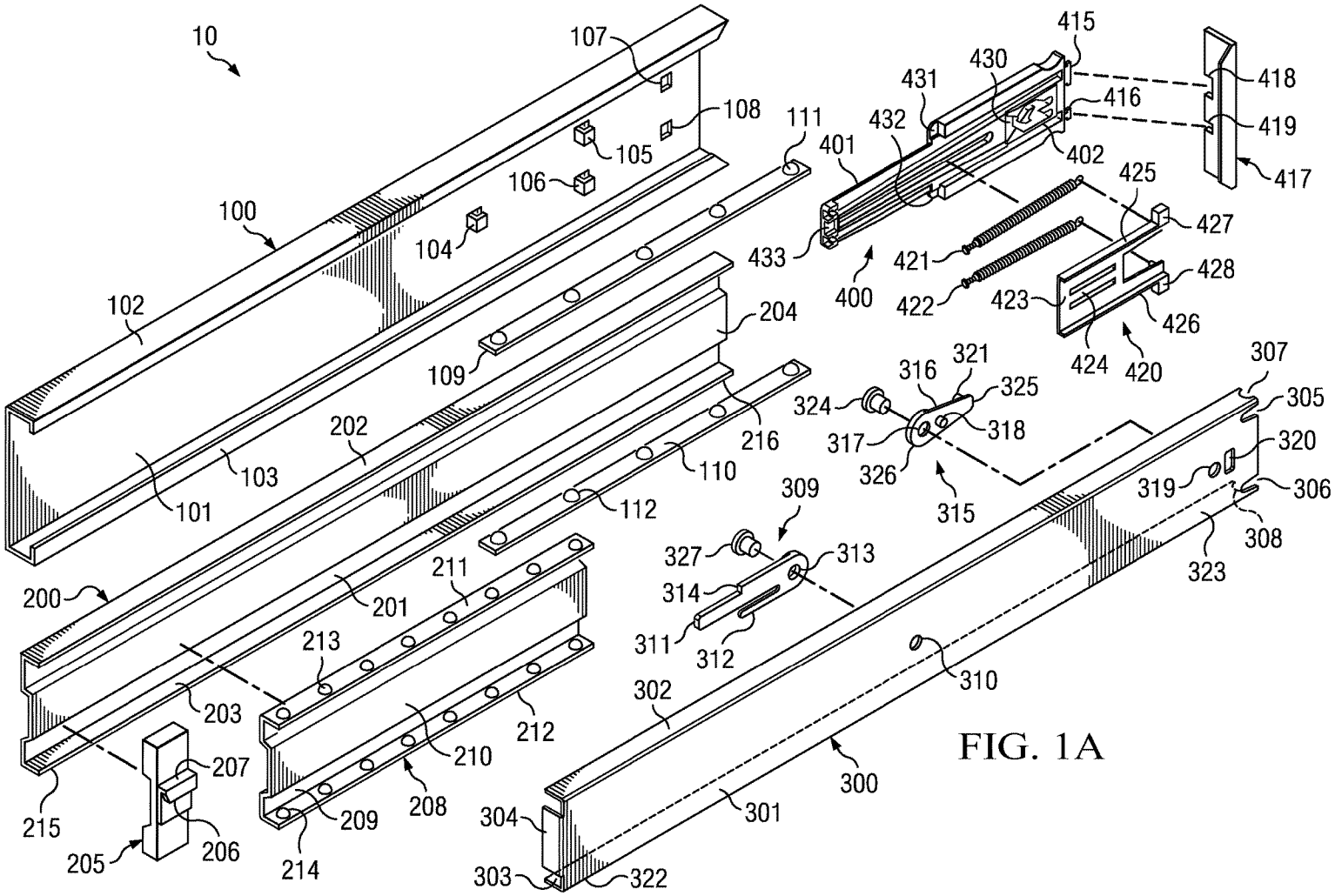
FIG. 1A is an exploded isometric view of a preferred embodiment.

Referring to FIG. 1A, drawer slide assembly 10 comprises outer slide member 100, intermediate slide member 200 telescopically mounted to outer slide member 100, and inner slide member 300 telescopically mounted to intermediate slide member 200. Outer slide member 100 has outer body portion 101 and opposing races 102 and 103 attached to outer body portion 101. Outer body portion 101 has catches 104, 105, and 106, and slots 107 and 108.

In a preferred embodiment, outer slide member 100 is made of a durable metal or metal alloy. Other durable materials known in the art may be used. Catches 104, 105, and 106 are raised portions of outer body portion 101 stamped into outer body portion 101 having a generally hooked shape. Slots 107 and 108 are generally rectangular holes cut out of outer body portion 101. Other shapes and structures known in the art may be employed to provide a fastening means.

Cage 109 telescopically slides into race 102. Cage 109 includes a plurality of ball bearings 111 inserted into holes in cage 109 and positioned along an inside surface of race 102. Cage 110 telescopically slides into race 103. Cage 110 includes a plurality of ball bearings 112 inserted into holes in cage 110 and positioned along an inside surface of race 103.

In a preferred embodiment, cages 109, 110, and ball bearings 111 and 112 are made of a durable metal or metal alloy. Other durable materials known in the art may be used.

Intermediate slide member 200 telescopically mounts to outer slide member 100 with cages 109 and 110 positioned between intermediate slide member 200 and outer slide member 100. An outside surface of race 202 is adjacent ball bearings 111 of cage 109. An outside surface of race 203 is adjacent ball bearings 112 of cage 110. Intermediate slide member 200 has intermediate body portion 201 and opposing races 202 and 203 attached to intermediate body portion 201, end 215, and end 216. Intermediate body portion 201 has ridge 204 formed into intermediate body portion 201 and extends longitudinally and generally centrally along intermediate body portion 201.

In a preferred embodiment, intermediate slide member 200 is made of a durable metal or metal alloy. Other durable materials known in the art may be used. Ridge 204 is a stamped portion of intermediate body portion 201. Other structures known in the art may be employed to form ridge 204.

Intermediate stop 205 attaches to intermediate slide member 200 at end 215. Intermediate stop 205 has stop ridge 206 and stop catch 207. Intermediate stop 205 has a cross-sectional shape similar that of intermediate slide member 200 enabling intermediate stop 205 to press-fit into intermediate slide member 200 at end 215 and conform to the cross-sectional shape of intermediate slide member 200. Other means of attachment known in the art may be employed.

In a preferred embodiment, intermediate stop 205 is made of a single piece of durable plastic. Other durable materials known in the art may be used.

Bearing retainer 208 telescopically inserts into intermediate slide member 200. Bearing retainer 208 has retainer body portion 209 and opposing cages 211 and 212 attached to retainer body portion 209. Retainer body portion 209 has retainer ridge 210 formed into retainer body portion 209 and extends longitudinally and generally centrally along retainer body portion 209. Cage 211 has a plurality of ball bearings 213 inserted into holes in cage 211. Cage 212 has a plurality of ball bearings 214 inserted into holes in cage 212.

In a preferred embodiment, bearing retainer 208, cages 211, 212, and ball bearings 213 and 214 are made of a durable metal or metal alloy. Other durable materials known in the art may be used. In this embodiment, retainer ridge 210 is a stamped portion of retainer body portion 209. Other structures known in the art may be employed to form retainer ridge 210.

Inner slide member 300 telescopically mounts to intermediate slide member 200 with bearing retainer 208 positioned between inner slide member 300 and intermediate slide member 200. Inner slide member 300 has inner body portion 301, opposing races 302 and 303, end 322, and end 323. End stop 304 is attached to inner body portion 301 at end 322. Inner body portion 301 has recesses 305 and 306 at end 323. Inner body portion 301 further has hole 310 through which fastener 327 is received, hole 319 through which fastener 324 is received, and guide slot 320. Race 302 has race slot 307 at end 323. Race 303 has race slot 308 at end 323.

In a preferred embodiment, inner slide member 300 is made of a durable metal or metal alloy. Other durable materials known in the art may be used. In this embodiment, guide slot 320 is generally rectangular in shape. In another embodiment, guide slot 320 is generally arcuate in shape. Other shapes will suffice.

Follower 315 pivotally connects to inner slide member 300 with fastener 324 inserted through hole 319. Follower 315 includes follower body 316. Follower body 316 has end 325, end 326, and pivot hole 317 at end 326 through which fastener 324 is inserted. Guide post 318 attaches to follower body 316 between end 325 and end 326 and extends generally perpendicularly from follower body 316 into guide slot 320 of inner body portion 301. Pin 321 attaches to follower body 316 at end 325 and extends generally perpendicularly from follower body 316 away from inner body portion 301.

In a preferred embodiment, follower 315 is formed of a single piece of plastic such as Delrin® and Teflon®. Other durable materials, including other plastics, metals and metal alloys, may be used. In this embodiment, fastener 324, is a flush rivet. Other suitable fasteners known in the art may be employed.

Latch 309 pivotally connects to inner body portion 301 with fastener 327 through hole 310. Latch 309 has latch handle 311, resilient member 312, shoulder 314, and hole 313, sized to receive fastener 327. Resilient member 312 urges shoulder 314 towards race 302. Shoulder 314 engages stop catch 207 of intermediate stop 205 to prevent disengagement of inner slide member 300 from intermediate slide member 200.

In a preferred embodiment, latch 309 is formed of a single piece of plastic such as Delrin® and Teflon®. Other durable materials, including other plastics, metals and metal alloys, may be used. In this embodiment, fastener 327, is a flush rivet. Other suitable fasteners known in the art may be employed.

Figure 1B:
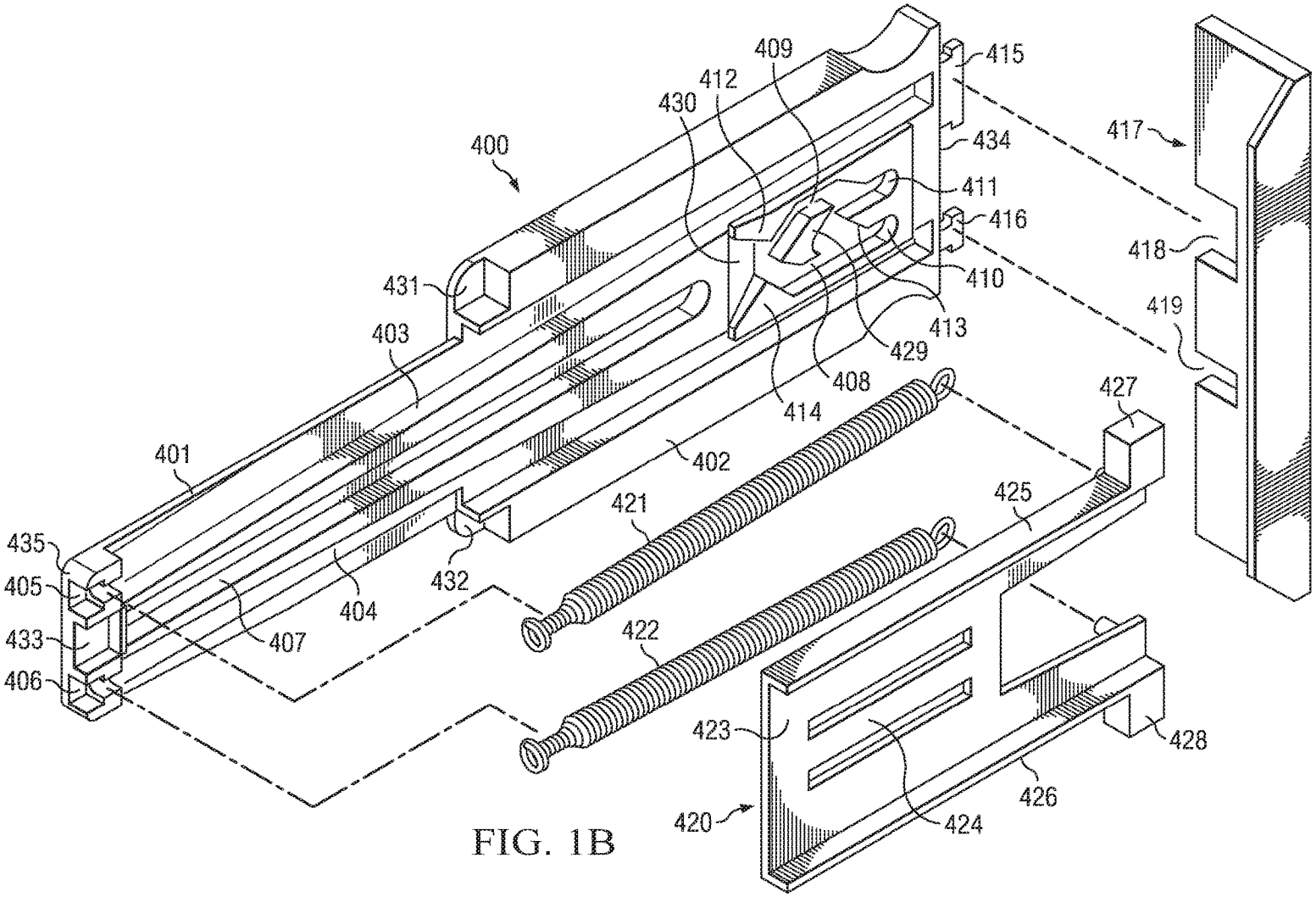
FIG. 1B is a detail view of a pressure release slide latch mechanism of a preferred embodiment.

Referring to FIG. 1B, channel plate 400 attaches to outer slide member 100. Channel plate 400 has track portion 401, guide block 402 is adjacent to track portion 401, end 434, and end 435. Track portion 401 has catch surfaces 431, 432, and 433 that frictionally engage with catches 104, 105, and 106 of outer body portion 101. Carriage track 407 is adjacent catch surface 433 and extends generally centrally and longitudinally along track portion 401. Spring guides 403 and 404 are each positioned on each longitudinal side of carriage track 407 immediately adjacent to catch surface 433 at end 435, extend along carriage track 407 increasing in distance from a central axis of carriage track 407, and extend between guide block 402 and outer body portion 101 to a distance approximately greater than the width of guide block 402 at end 434. Spring guide 403 has spring hold 405 adjacent catch surface 433 to secure spring 421. Spring guide 404 has spring hold 406 adjacent catch surface 433 to secure spring 422.

Carriage 420 slidingly engages with track portion 401. Carriage 420 has frame 423, extension 425, and extension 426. Frame 423 has rail 424 extending generally centrally and longitudinally along frame 423 to slidingly engage with carriage track 407 of track portion 401. Extension 425 has bumper 427 to which spring 421 is further attached. Extension 426 has bumper 428 to which spring 422 is further attached. The attachment of springs 421 and 422 to track portion 401 and carriage 420 biases carriage 420 along track portion 401.

Guide block 402 has ramp 430, inlet shoulder 412, inlet channel 409, positioning recess 411, latch member 429, redirecting surface 413, positioning recess 410, outlet channel 408, and outlet shoulder 414. Guide block 402 further has lug 415 and lug 416. Lugs 415 and 416 frictionally engage with slots 418 and 419, respectively, of base 417. Base 417 frictionally engages with the ends of races 102 and 103 of outer slide member 100.

In a preferred embodiment, channel plate 400, carriage 420, and base 417 are made of plastic. Other durable materials, including metals and metal alloys, may be used. In this embodiment, springs 421 and 422 are coil tension springs. Other resilient materials known in the art including, but not limited to elastic rubber bands may be employed. Other resilient biasing means known in the art may be employed including, but not limited to compression springs, elastomeric materials such as neoprene, fluid-filled piston/cylinder arrangements, and combinations thereof positioned in spring guide 403 and/or spring guide 404 at end 434 to urge carriage 420 towards end 435 will suffice.

Figure 2:
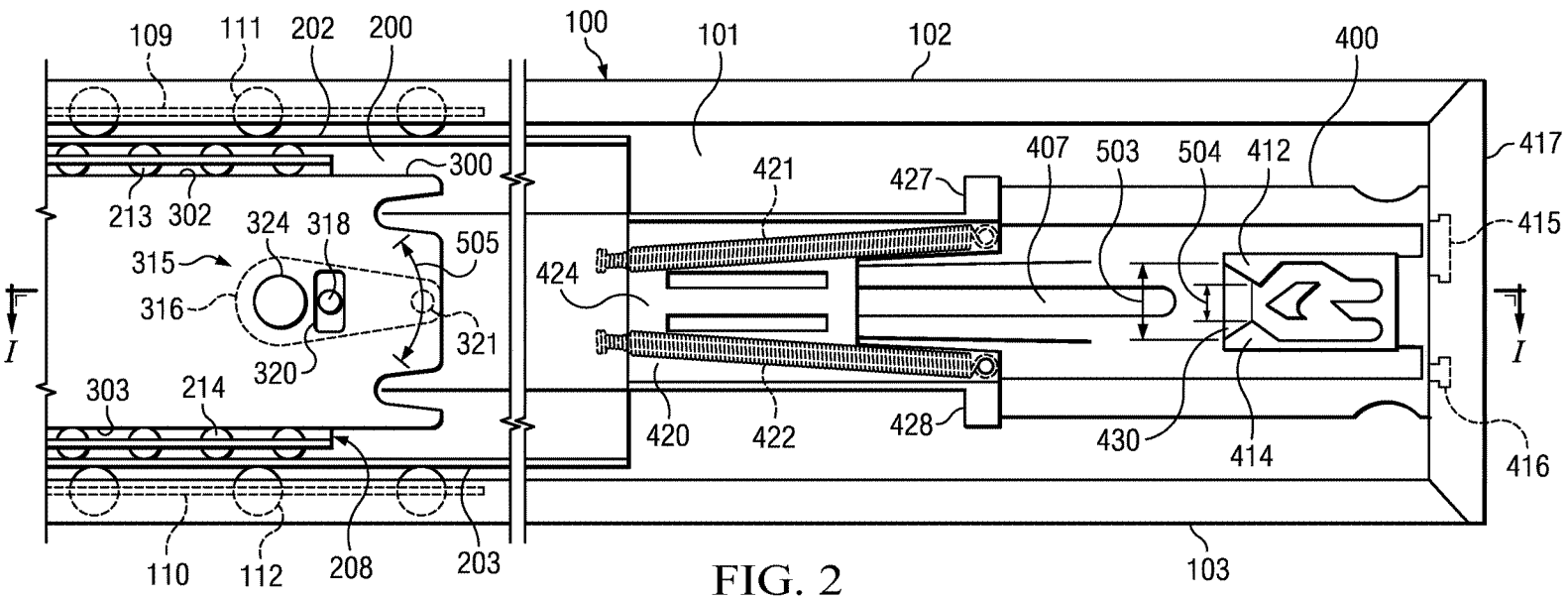
FIG. 2 is an assembled side view of a preferred embodiment.

Referring to FIG. 2, cage 109 inserts into race 102 of outer slide member 100 and ball bearings 111 are positioned in race 102 to roll within race 102 and along the outside surface of race 202 of intermediate slide member 200. Cage 110 inserts into race 103 of outer slide member 100 and ball bearings 112 are positioned in race 103 to roll within race 103 and along the outside surface of race 203 of intermediate slide member.

Bearing retainer 208 inserts into intermediate slide member 200 such that ball bearings 213 position between inside surface of race 202 and the outside surface of race 302 of inner slide member 300, and ball bearings 214 position between inside surface of race 203 and the outside surface of race 303 of inner slide member 300.

Ramp 430 has a generally trapezoidal shape with width 503 and width 504. Width 503 is greater than width 504.

Follower 315 pivotally attaches to inner slide member 300 with fastener 324. The pivotal movement of follower 315 is controlled by the sliding engagement of guide post 318 with guide slot 320. Guide slot 320 has dimensions to enable pin 321 to swing through arcuate path 505. Arcuate path 505 is less than width 503 of ramp 430 to consistently direct pin 321 into guide block 402.

Rail 424 of carriage 420 slidingly engages with carriage track 407 of track portion 401. Springs 421 and 422 bias carriage 420 along carriage track 407.

Base 417 frictionally engages with outer slide member 100 and lugs 415 and 416 to further secure channel plate 400 to outer slide member 100.

Figure 3:
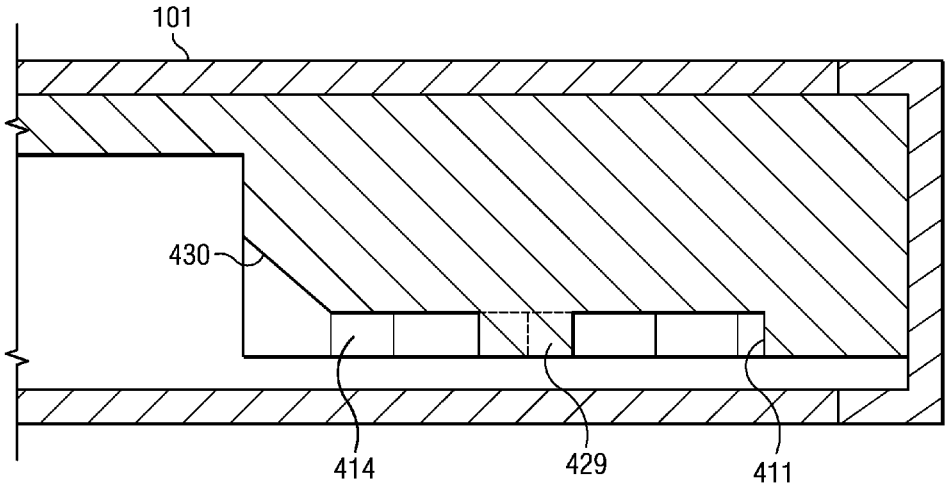
FIG. 3 is a partial section view of a guide block of a preferred embodiment taken along line I-I of FIG. 2.
Figure 4:
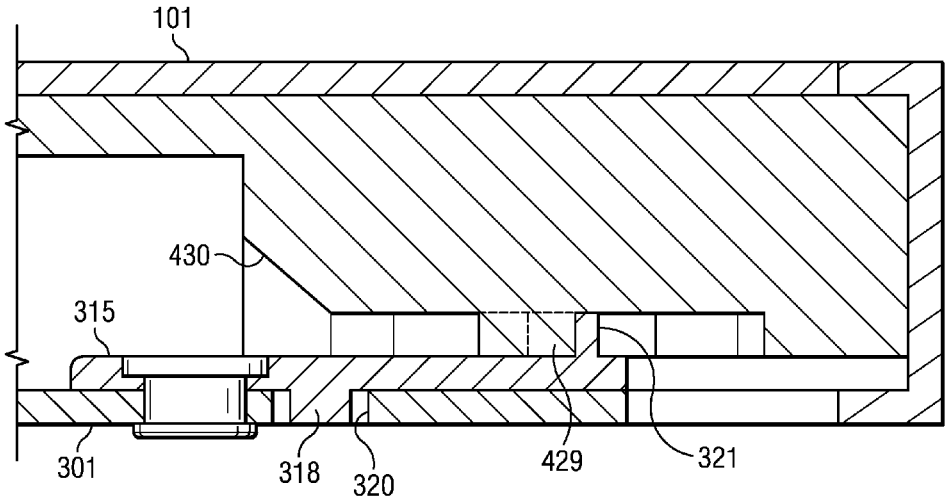
FIG. 4 is a partial section view of a guide block engaged with a follower of a preferred embodiment taken along line I-I of FIG. 2.

Referring to FIGS. 3 and 4, ramp 430 is angled with respect to outer body portion 101 to consistently direct pin 321 into guide block 402, around latch member 429, into positioning recess 411, and to abut pin 321 against latch member 429. Ramp 430 is angled to provide consistent operation during deflection of drawer slide assembly 10. In a case in which follower 315 separates, but remains loosely fastened to inner slide member 300, pin 321 slidingly engages ramp 430 to consistently enter guide block 402.

Figure 5:
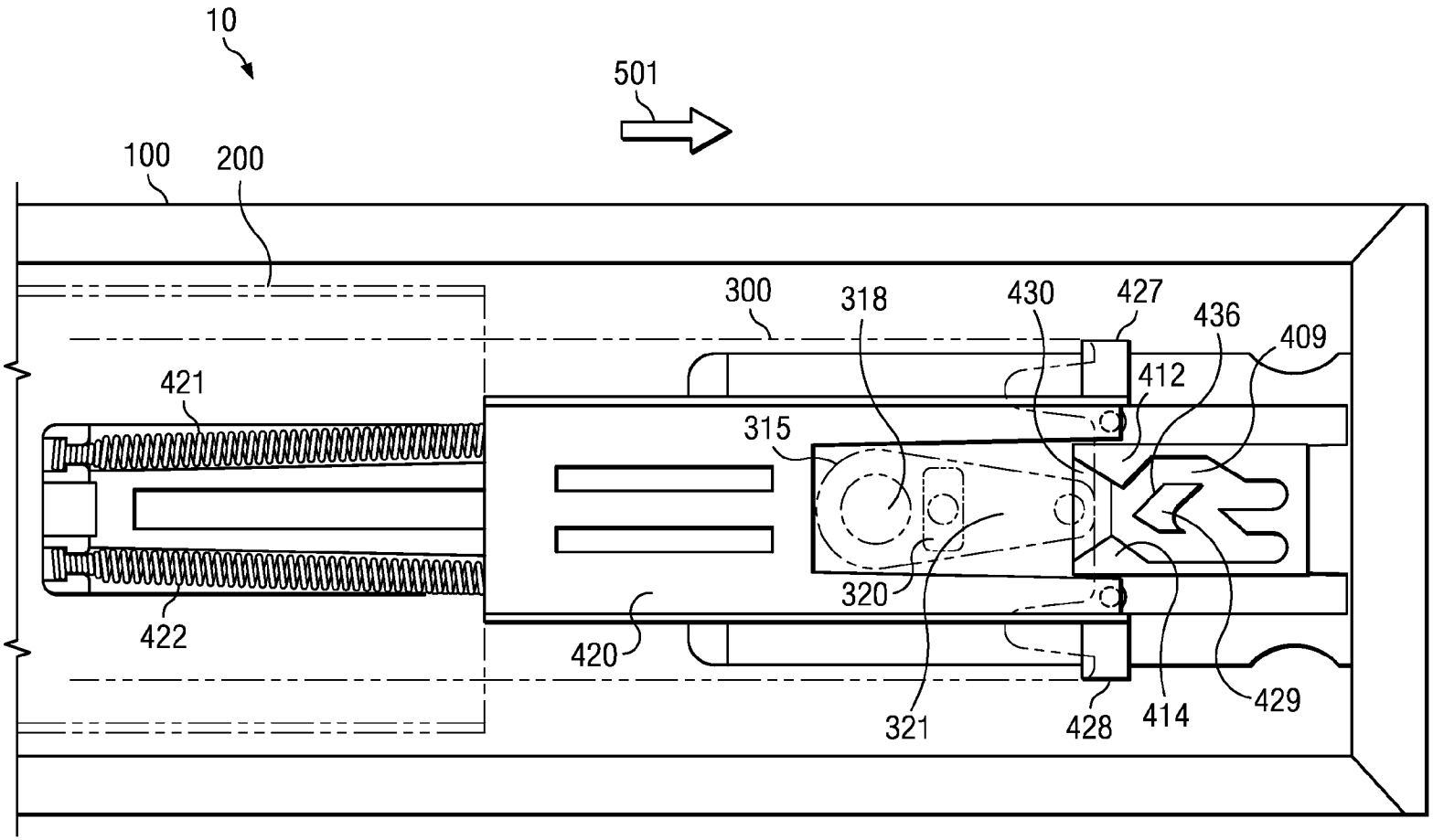
FIG. 5 is a side view of a follower approaching a guide block of a preferred embodiment.

Referring to FIG. 5 in use, to close drawer slide assembly 10, inner slide member 300 and intermediate slide member 200 move in proximal direction 501. Intermediate slide member 200 engages carriage 420 and urges carriage 420 in proximal direction 501 against the bias of springs 421 and 422. Inner slide member 300 engages bumpers 427 and 428 to further urge carriage 420 against the bias of springs 421 and 422. Pin 321 positions between inlet shoulder 412 and outlet shoulder 414 by guide post 318 and guide slot 320 and slidingly engages with ramp 430. Guide post 318 is located generally centrally in guide slot 320. As inner slide member 300 and intermediate slide member 200 continue to move in proximal direction 501, pin 321 engages redirecting surface 436 of latch member 429 and redirects pin 321 into inlet channel 409.

Figure 6:
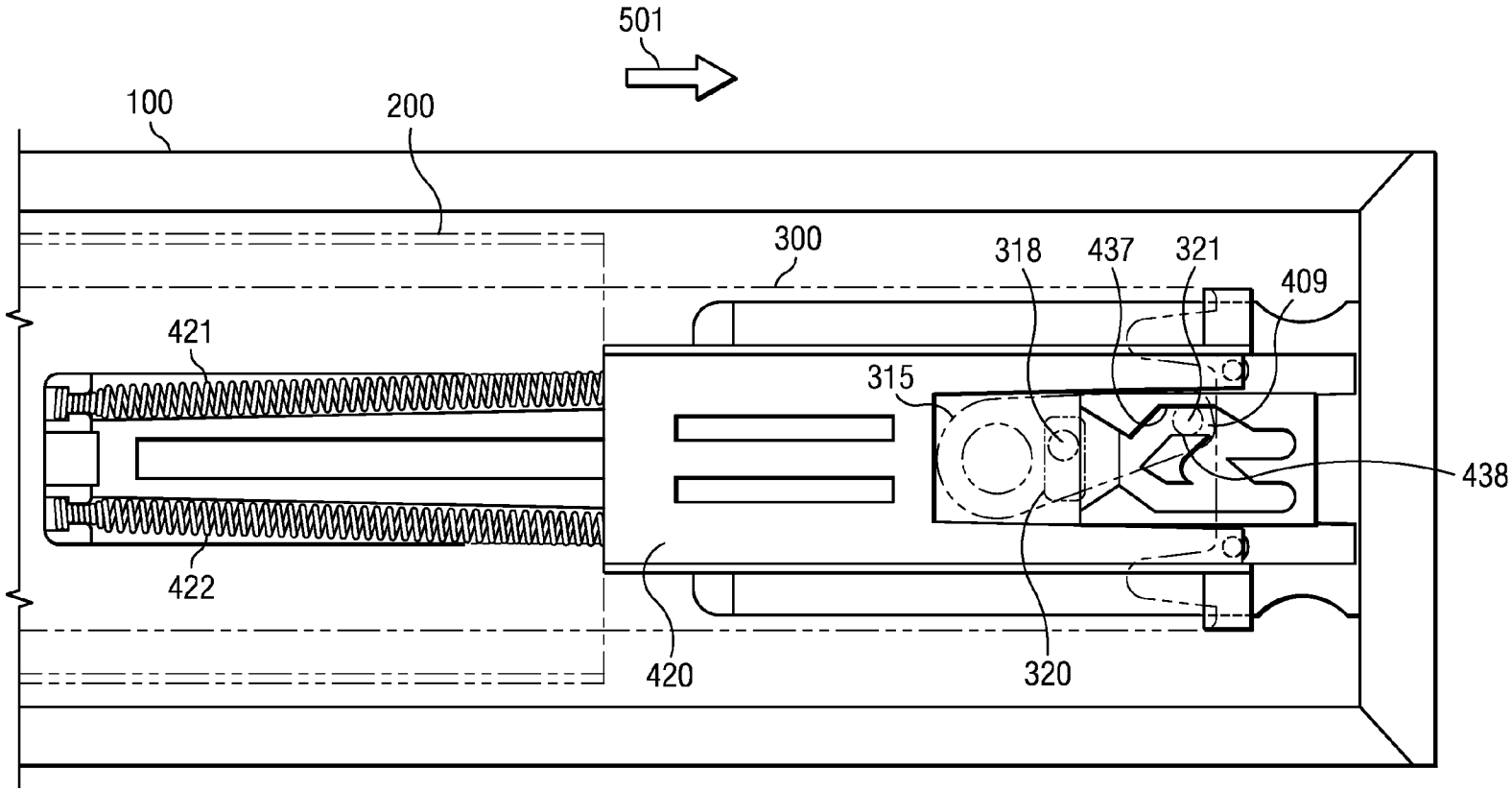
FIG. 6 is a side view of a follower engaged with an inlet channel of a guide block of a preferred embodiment.

Referring to FIG. 6, as inner slide member 300 and intermediate slide member 200 further urge carriage 420 in proximal direction 501 against the bias of springs 421 and 422, pin 321 is directed into inlet channel 409 between redirecting surfaces 437 and 438 thereby pivoting follower 315 and moving guide post 318 to a first end of guide slot 320.

Figure 7:
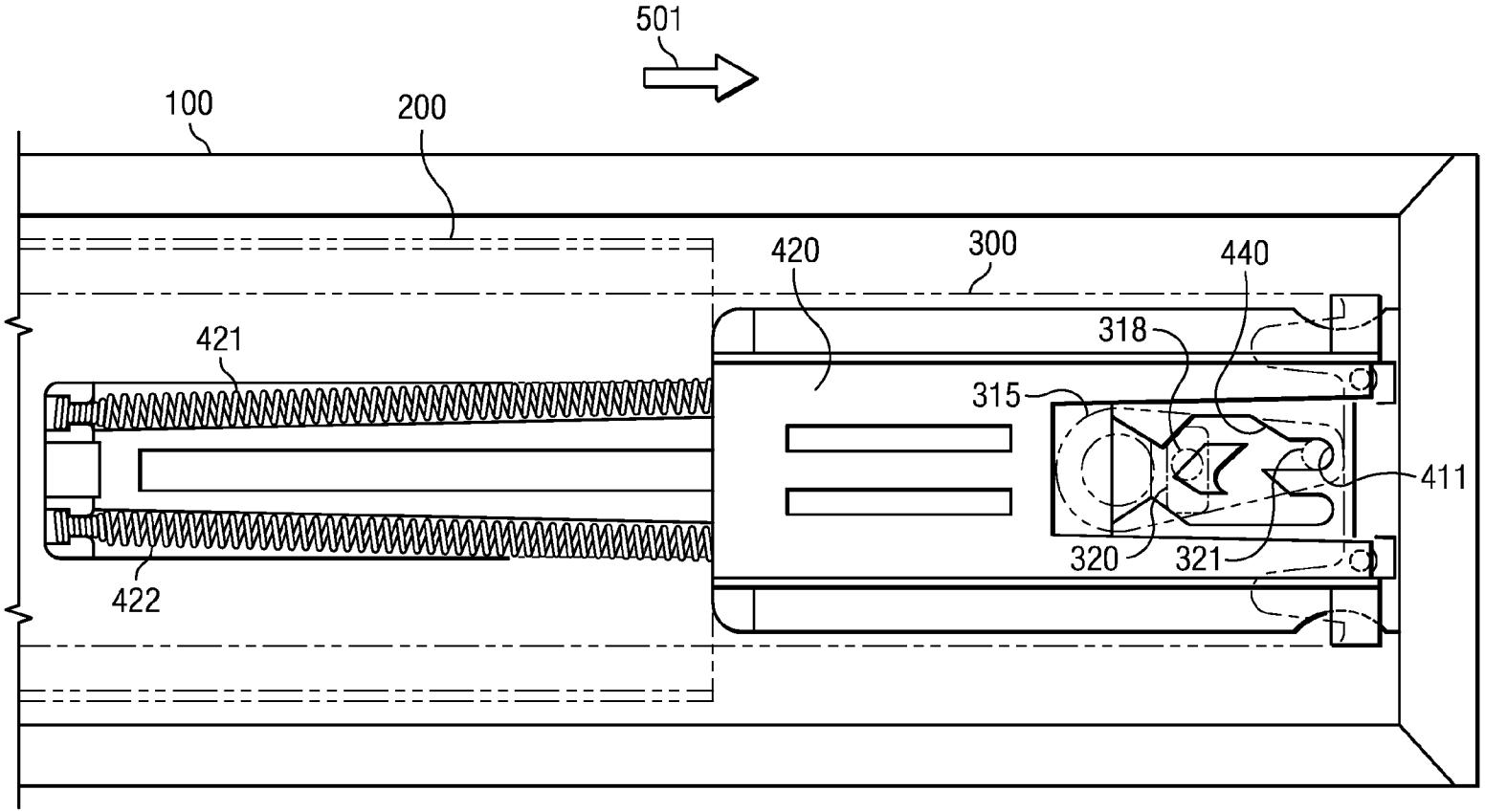
FIG. 7 is a side view of a follower engaged with a positioning recess of a guide block of a preferred embodiment.

Referring to FIG. 7, as inner slide member 300 and intermediate slide member 200 further urge carriage 420 in proximal direction 501 against the bias of springs 421 and 422, pin 321 is redirected into positioning recess 411 by redirecting surface 440. Follower 315 pivots away from the first end of guide slot 320 towards the center of guide slot 320.

Figure 8:
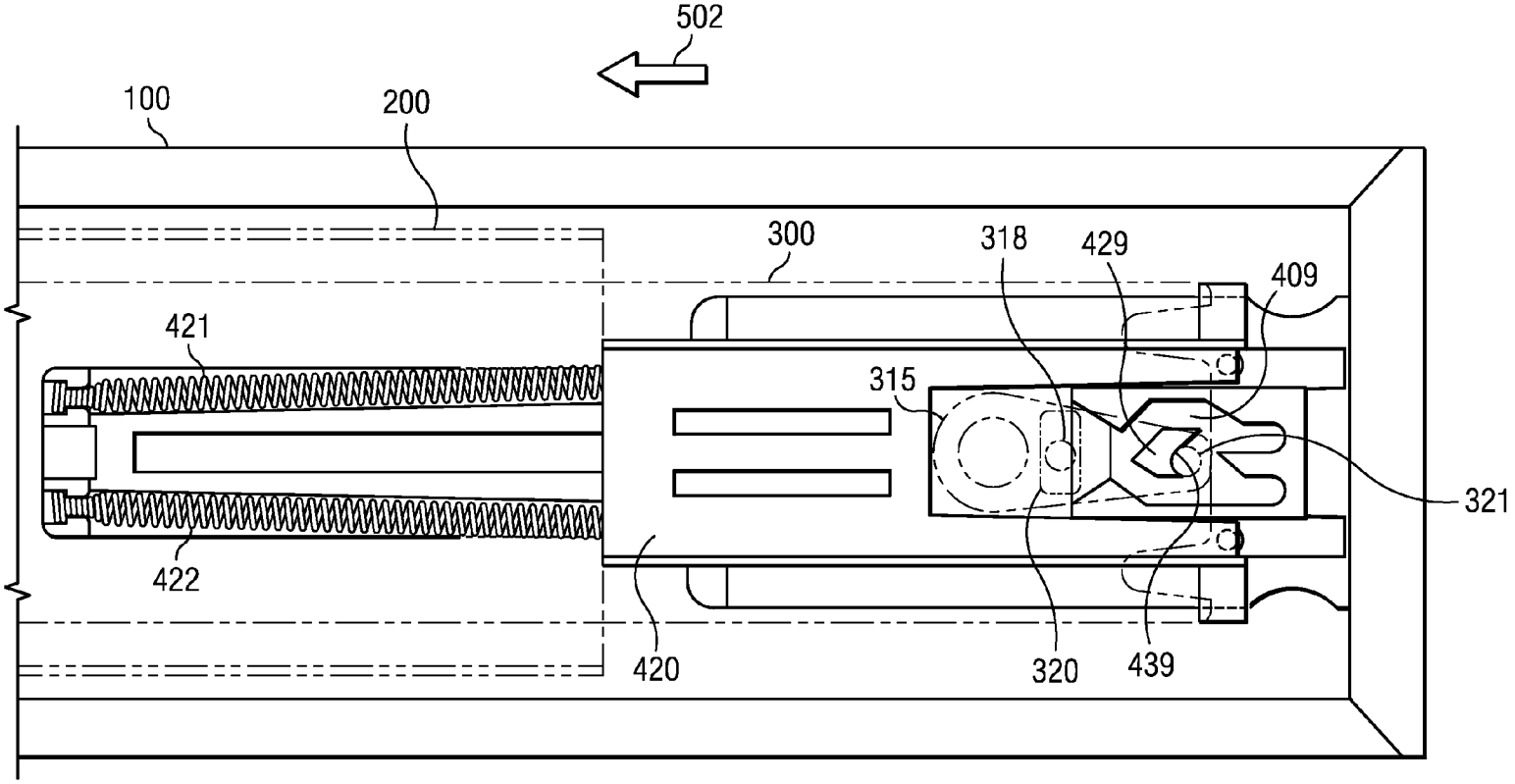
FIG. 8 is a side view of a follower engaged with a catch surface of a guide block of a preferred embodiment.

Referring to FIG. 8, inner slide member 300 and intermediate slide member 200 move in distal direction 502 under the bias of springs 421 and 422 connected to carriage 420 that urges intermediate slide member 200, inner slide member 300, and thereby pin 321 to engage latch surface 439 of latch member 429. The bias of intermediate slide member 200, inner slide member 300, and thereby pin 321 against latch member 429 by springs 421 and 422, releasably maintains inner slide member 300 and intermediate slide member 200 in a closed retracted position with respect to outer slide member 100.

Figure 9:
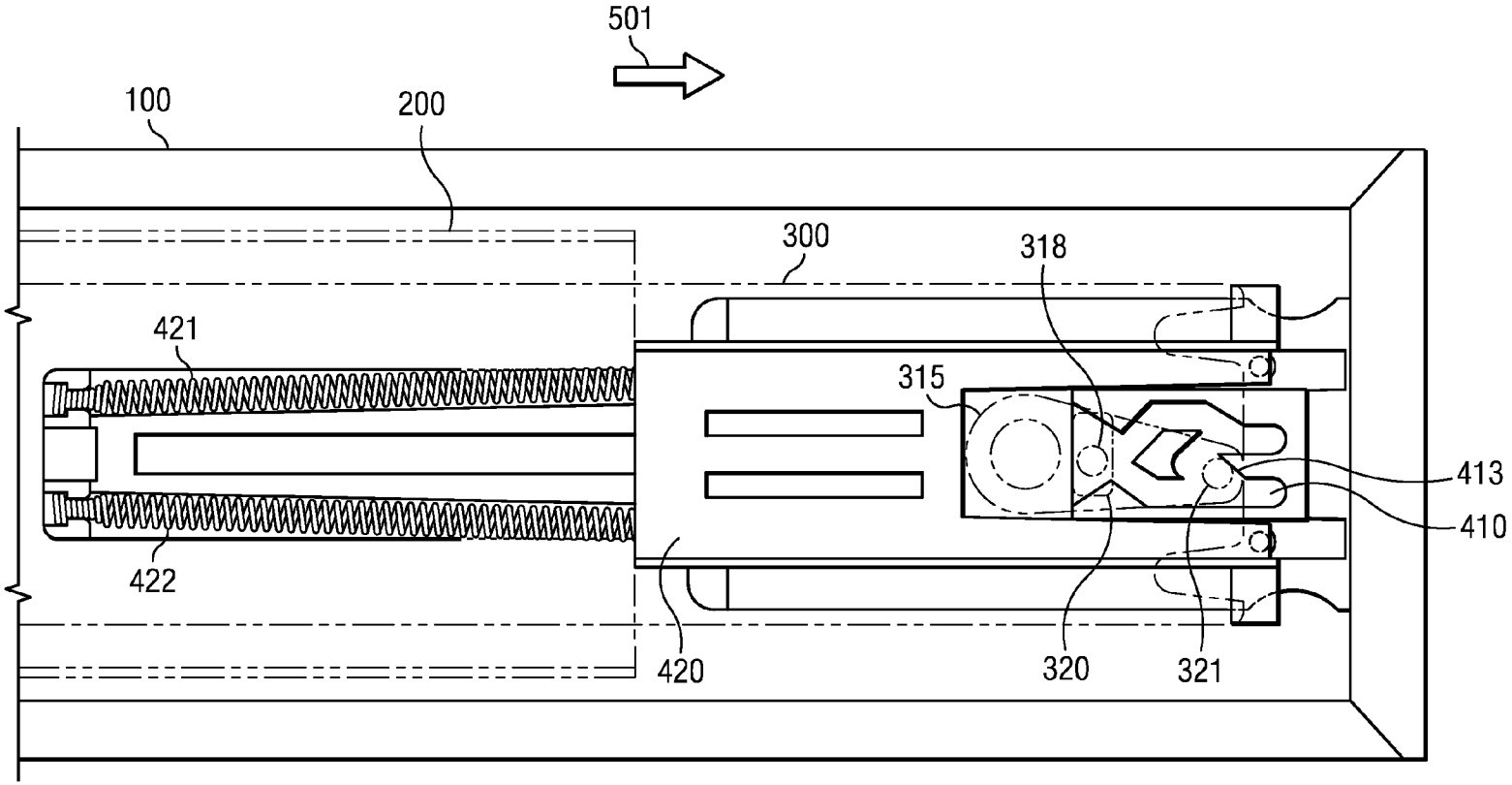
FIG. 9 is a side view of a follower engaged with a redirecting surface of a guide block of a preferred embodiment.

Referring to FIG. 9, to release inner slide member 300 and intermediate slide member 200, inner slide member 300 and intermediate slide member 200 move in proximal direction 501 and urge carriage 420 against the bias of springs 421 and 422. Pin 321 engages redirecting surface 413 to direct pin 321 towards positioning recess 410. Follower 315 pivots towards positioning recess 410 and guide post 318 slides towards a second end of guide slot 320.

Figure 10:
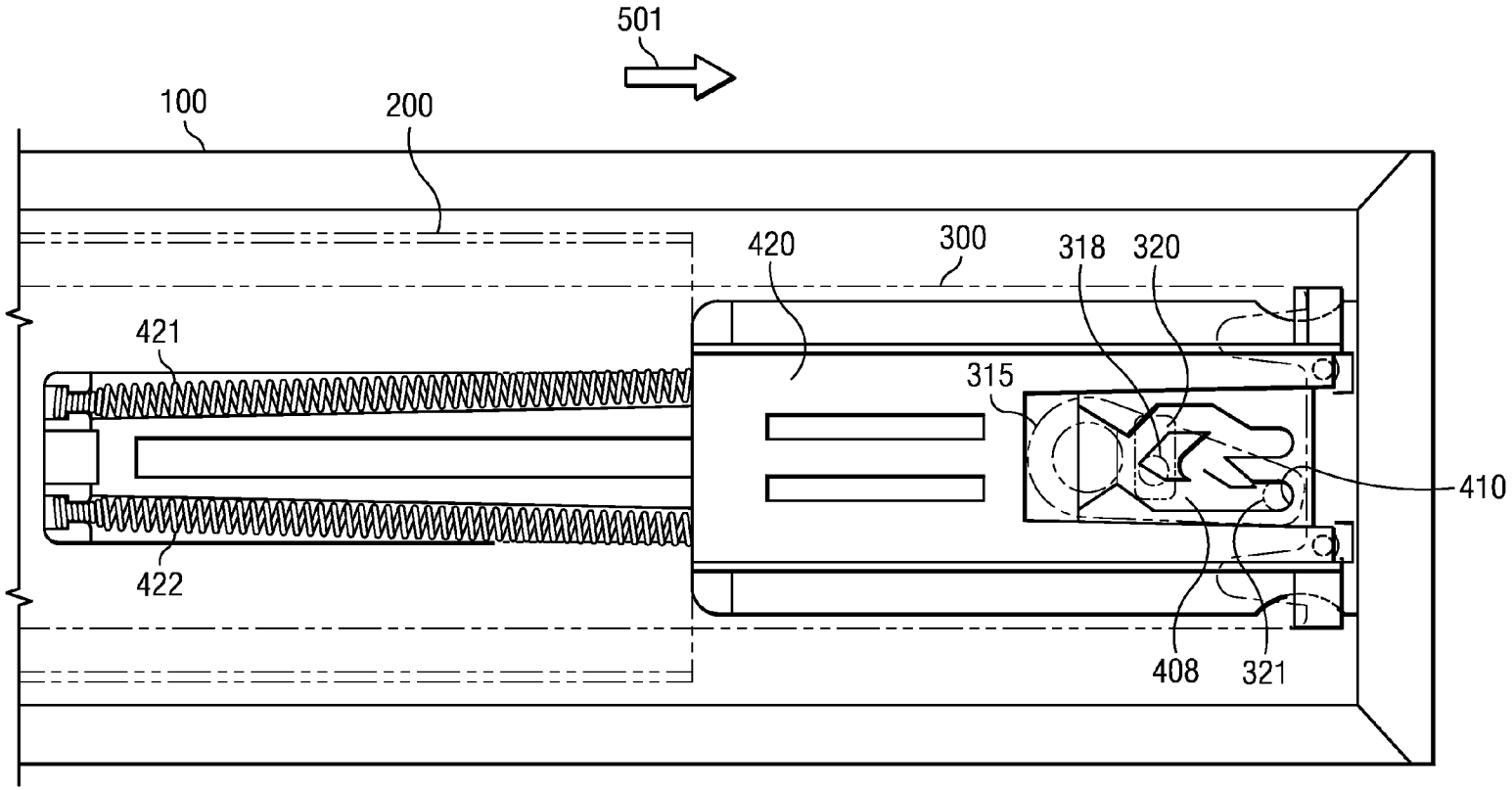
FIG. 10 is a side view of a follower engaged with a positioning recess of a guide block of a preferred embodiment.

Referring to FIG. 10, inner slide member 300 and intermediate slide member 200 further move in proximal direction 501 and urge carriage 420 against the bias of springs 421 and 422. Pin 321 situates in positioning recess 410. Follower 315 pivots towards positioning recess 410 and guide post 318 slides to the second end of guide slot 320. From positioning recess 410, pin 321 can now move into outlet channel 408.

Figure 11:
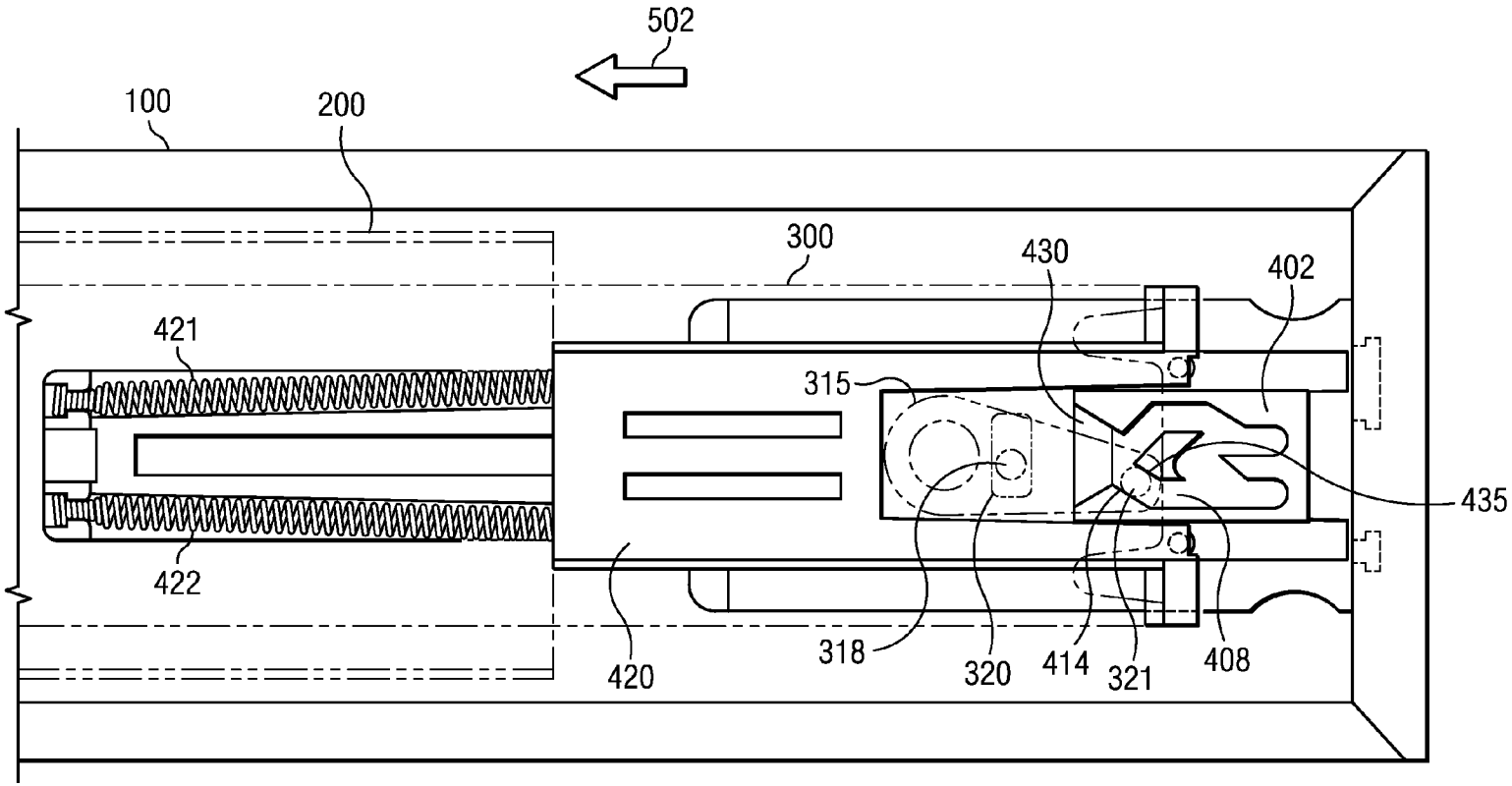
FIG. 11 is a side view of a follower engaged with a redirecting surface of a guide block of a preferred embodiment.

Referring to FIG. 11, inner slide member 300 and intermediate slide member 200 move under the bias of springs 421 and 422 in distal direction 502. Pin 321 has moved through outlet channel 408 and engages redirecting surface 414. Redirecting surface 414 redirects pin 321 towards ramp 430 to exit guide block 402. The redirection of pin 321 by redirecting surface 414 pivots follower 315 back to a generally neutral position thereby releasing inner slide member 300 and intermediate slide member 200 allowing inner slide member 300 and intermediate slide member 200 to extend with respect to outer slide member 100 and positioning follower 315 for further engagement with ramp 430

Figure 12C:
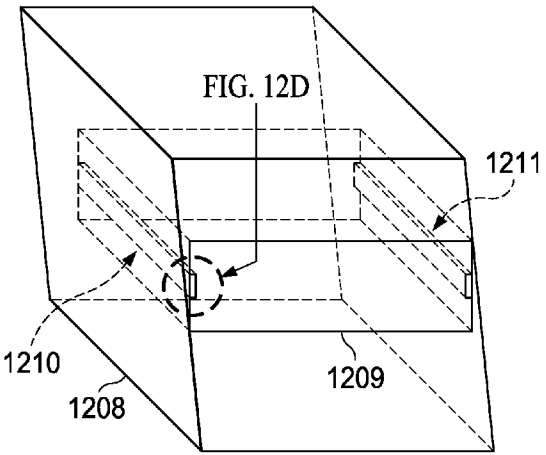
FIG. 12C is an isometric view of a misaligned cabinet.
Figure 12D:
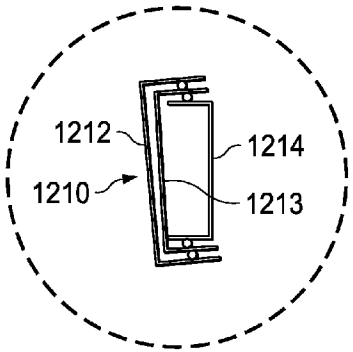
FIG. 12D is an isometic view of a misaligned slide.
Figure 12A:
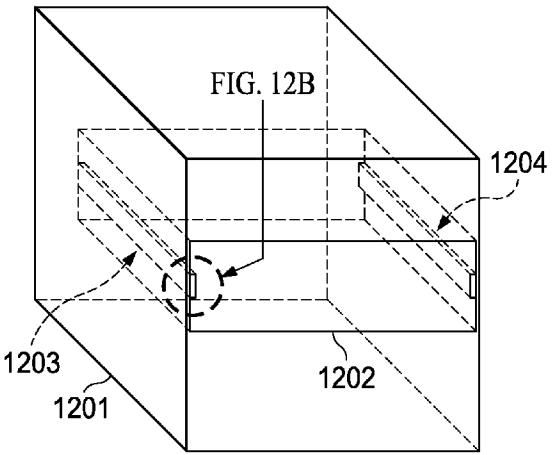
FIG. 12A is an isometric view of a cabinet.
Figure 12B:
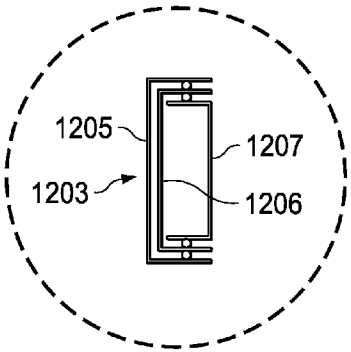
FIG. 12B is an isometric view of an aligned cabinet.

Referring to FIGS. 12A and 12B in another embodiment, drawer 1202 is mounted to cabinet carcass 1201 with drawer slide assemblies 1203 and 1204. Drawer slide assemblies 1203 and 1204 are the same in construction. By way of example, drawer slide assembly 1203 includes outer slide member 1205, intermediate slide member 1206 telescopically mounted to outer slide member 1205, and inner slide member 1207 telescopically mounted to intermediate slide member 1206. Outer slide member 1205 is secured to cabinet carcass 1201 and inner slide member 1207 is secured to drawer 1202. Each of cabinet 1201 and drawer 1202 is generally "squared" in alignment, thereby enabling drawer slide assemblies 1203 and 1204 to be parallel and thus operate without interference.

It will be appreciated by those skilled in the art that a drawer slide assembly having two slide members, an outer slide member and an inner slide member telescopically mounted to the outer slide member, may be employed.

Referring to FIGS 12C and 12D, drawer 1209 is mounted to cabinet carcass 1208 with drawer slide assemblies 1210 and 1211. Drawer slide assemblies 1210 and 1211 have the same construction as drawer slide assemblies 1203 and 1204 and are secured to cabinet carcass 1208 and drawer 1209 in the same manner as drawer slide assemblies 1203 and 1204. However, as shown, cabinet carcass 1208 is misaligned, i.e., not "squared" in alignment. Yet, drawer 1209 is "squared" in alignment. The misalignment of cabinet carcass 1208 forces the outer slide members to be misaligned. This misalignment creates a torque within drawer slide assembly 1210 causing outer slide member 1212 to become misaligned with respect to intermediate slide member 1213 and intermediate slide member 1213 to become misaligned with respect to inner slide member 1214

In use, the misalignment of cabinet carcass 1208 and thereby drawer slide assemblies 1210 and 1211 creates interference points between parts within each of drawer slide assemblies 1210 and 1211. The interference points cause each of drawer slide assemblies 1210 and 1211 and the interfering parts therein to bind and eventually fail, as will be further described below.

Figure 13:
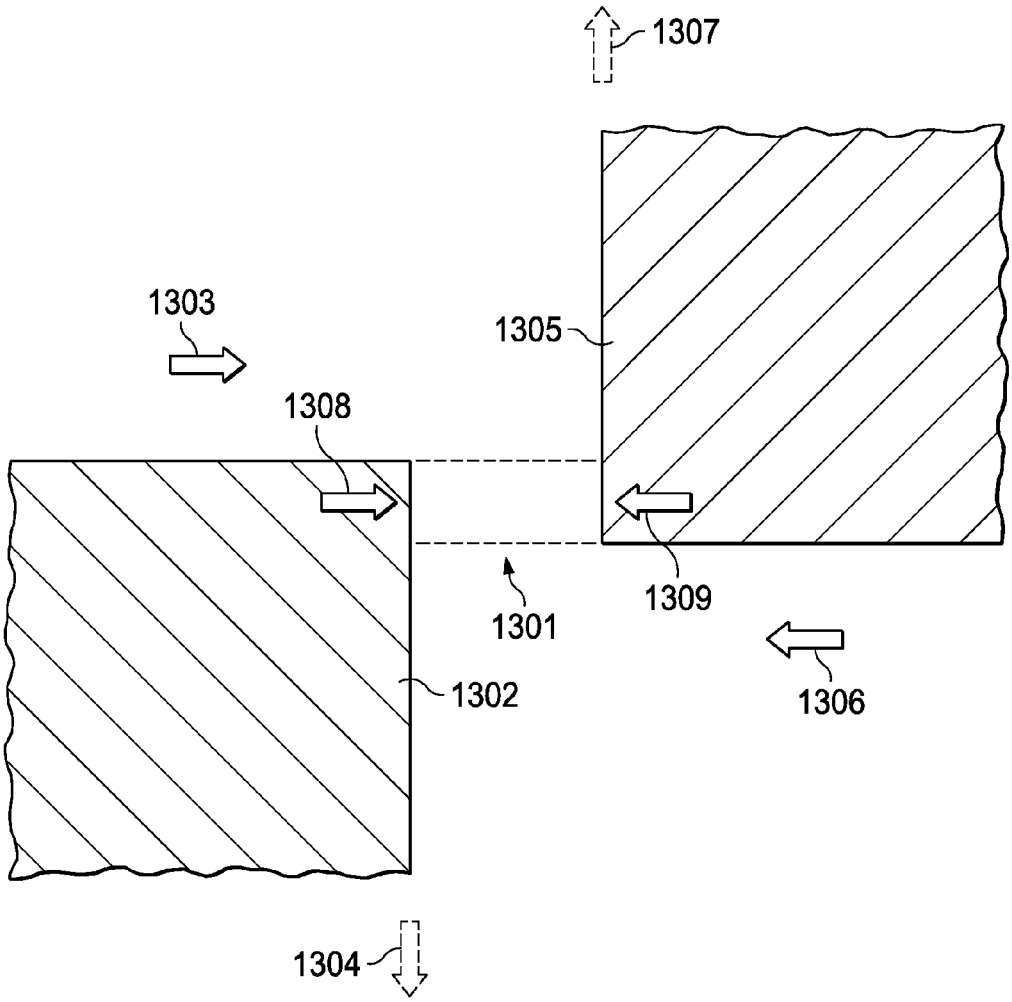
FIG. 13 is a detail view of an interference point.

Referring to FIG. 13, and by way of example, at interference point 1301 part surface 1302 moves in direction 1303 towards part surface 1305 and part surface 1305 moves in direction 1306 towards part surface 1302. Each of part surfaces 1302 and 1305 has a generally square corner. Part surfaces 1302 and 1305 have the ability to move in directions 1304 and 1307, respectively.

When part surfaces 1302 and 1305 make contact, force 1308 of part surface 1302 is exerted on part surface 1305 and force 1309 of part surface 1305 is exerted on part surface 1302. The square corners prevent part surfaces 1302 and 1305 from moving in directions 1304 and 1307, respectively, and thereby prevent part surfaces 1302 and 1305 from continuing to move in directions 1303 and 1306, respectively. As a result, forces 1308 and 1309 can be of any magnitude and prevent movement of part surfaces 1302 and 1305 in directions 1304 and 1307 until failure occurs in each of part surfaces 1302 and 1305.

Figure 14:
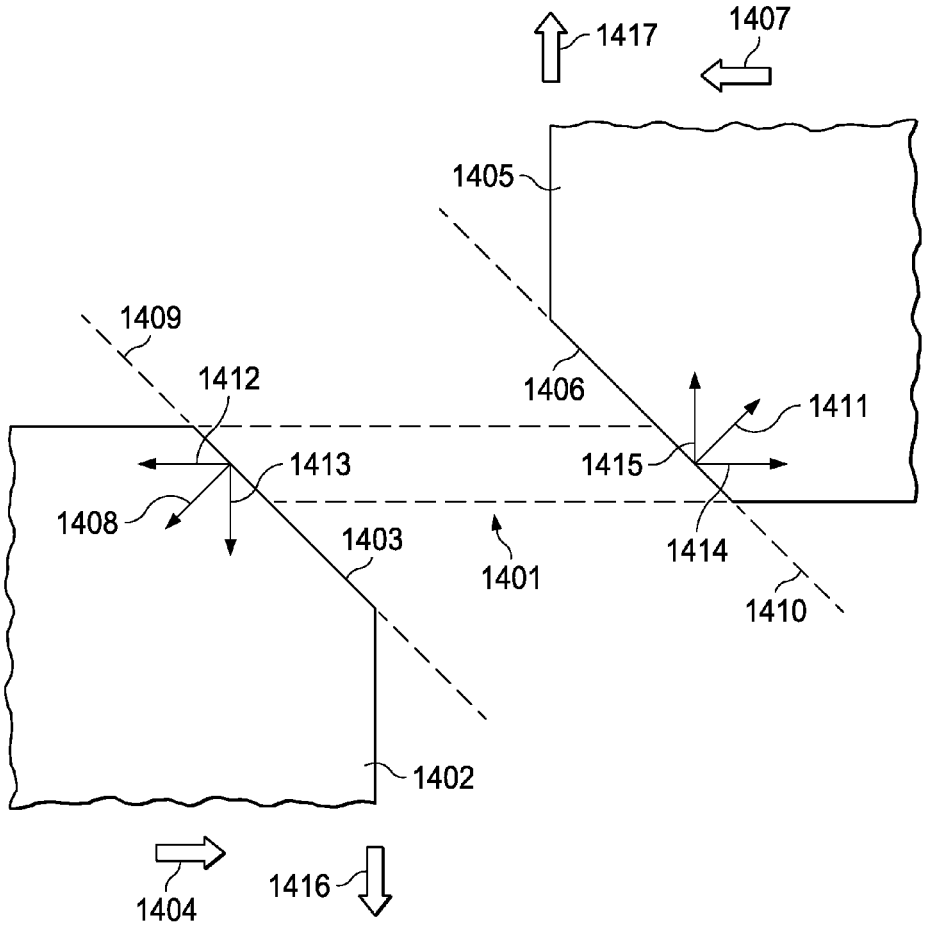
FIG. 14 is a detail view of a modified interference point of a preferred embodiment.

Referring to FIG. 14, at interference point 1401, modified part surface 1402 has chamfer 1403. Modified part surface 1405 has chamfer 1406. Modified part surface 1402 moves in direction 1404 towards modified part surface 1405 and modified part surface 1405 moves in direction 1407 towards modified part surface 1402. Modified part surfaces 1402 and 1405 are able to move in directions 1416 and 1417, respectively.

When modified part surfaces 1402 and 1405 make contact, force 1411 is exerted on modified part surface 1405 and force 1408 is exerted on modified part surface 1402. Force 1408 is generally perpendicular to line 1409. Line 1409 is generally parallel to chamfer 1403. Force 1411 is generally perpendicular to line 1410. Line 1410 is generally parallel to chamfer 1406. Force 1408 has force components 1412 and 1413. Each of force components 1412 and 1413 is perpendicular with respect to each other. Force 1411 has force components 1414 and 1415. Each of force components 1414 and 1415 is perpendicular with respect to each other. Force component 1413 moves modified part surface 1402 in direction 1416 and force component 1415 moves modified part surface 1405 in direction 1417. After modified part surfaces 1402 and 1405 make contact, chamfers 1403 and 1406 enable modified part surfaces 1402 and 1405 to move away from each other in directions 1416 and 1417, respectively, and past each other in directions 1404 and 1407, respectively.

Figure 15A:
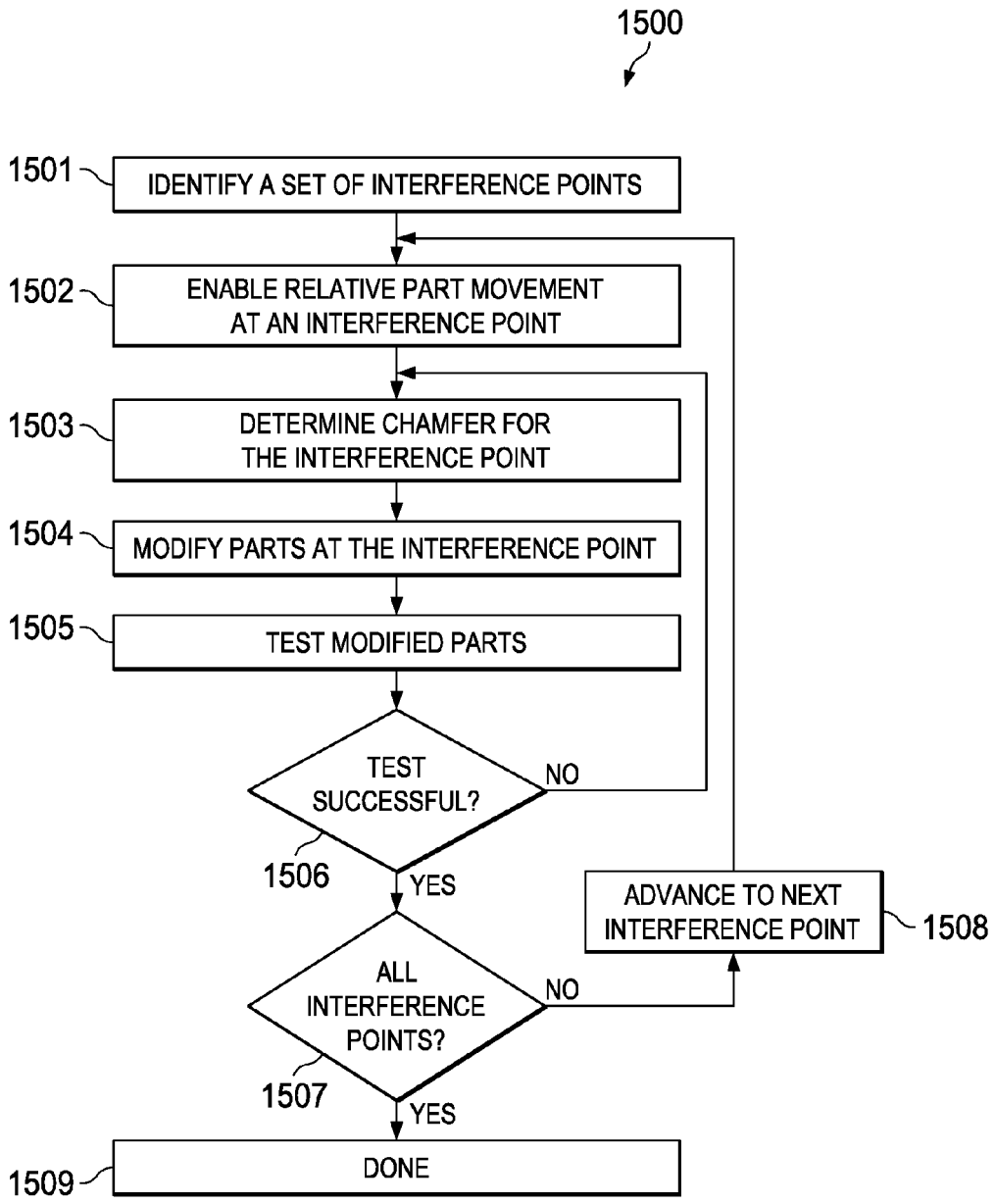
FIG. 15A is a flowchart of a method for modifying a drawer slide assembly of a preferred embodiment.

Referring to FIG. 15A, method 1500 for modifying a drawer slide assembly is described. In step 1501, a set of interference points in a drawer slide assembly is identified. In this step, the set of interference points is a set of points at which a set of parts of the drawer slide assembly interfere so as to cause binding and prevent the drawer slide assembly from operating. For example, channel plate 400 may interfere with the movement of inner slide member 300. In another example, guide block 402 may interfere with the movement of carriage 420.

In step 1502, a relative part movement at an interference point of the set of interference points is enabled. In this step, movement of the set of parts at the interference point is enabled relative to each other so that once modified, the set of parts can move past each other. For example, a fastener securing a part in the set of parts may be loosened to enable movement of the part. In another example, catches 104, 105, and 106 may be loosed to enable movement of channel plate 400.

Figure 15B:
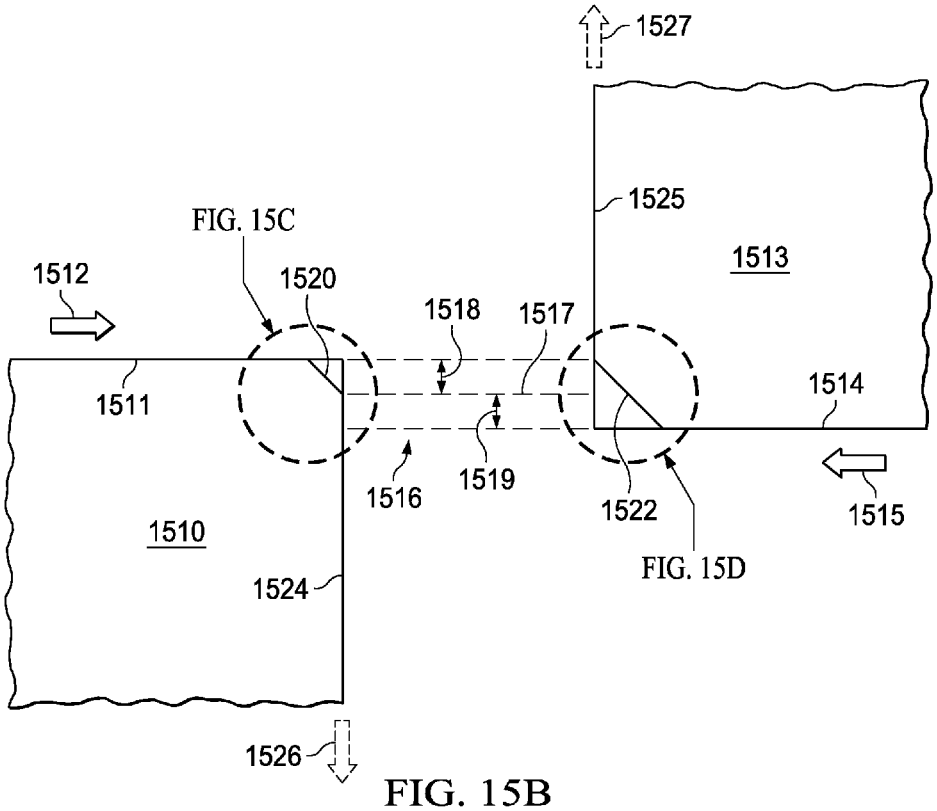
FIG. 15B is a detail view of a modified interference point of a preferred embodiment.
Figure 15C:
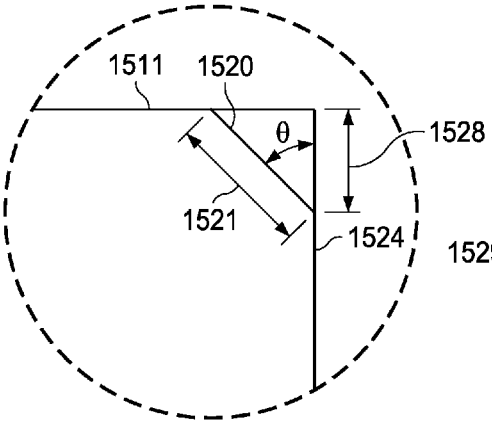
FIG 15C is a detail view of chamfer.
Figure 15D:
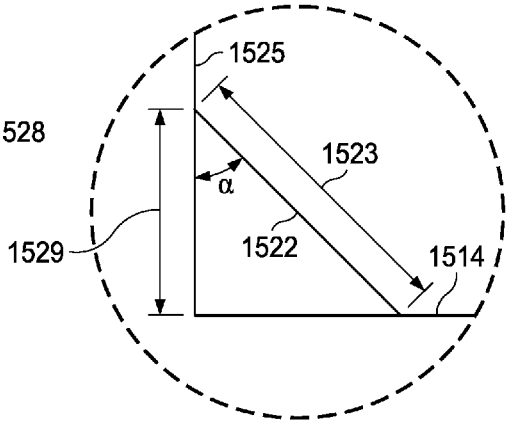
FIG. 15D is a detail view of a chamfer

In step 1503, an example of a chamfer for an interference point is determined. Referring to FIGS. 15B, 15C and 15D, part surface 1510 has sides 1511 and 1524 and moves in direction 1512. Part surface 1510 is enabled to move in direction 1526.Part surface 1513 has sides 1514 and 1525 and moves in direction 1515. Part surface 1513 is enabled to move in direction 1527. At interference point 1516, side 1511 must move at least minimum interference distance 1518 in direction 1526 past clearance line 1517 and side 1514 must move at least minimum interference distance 1519 in direction 1527 past clearance line 1517 so part surfaces 1510 and 1513can move past each other. Minimum interference distances 1518 and 1519 are measured. An interference point may exist at any point of contact between two moving parts.

In order move past clearance line 1517 upon contact with each other, part surface 1510 has chamfer 1520 having length 1521, angle θ, and chamfer distance 1528 and part surface 1513 has chamfer 1522 having length 1523, angle α, and chamfer distance 1529. Chamfer 1520 connects sides 1511 and 1524. Chamfer 1522 connects sides 1514 and 1525. The relationship between length 1521, angle θ, and interference distance 1518 is defined as:

$$l_{c_1} \cos \theta \geq d_1 \qquad \text{Rel. 1}$$

where $l_{c_1}$ is length 1521, θ is the angle between side 1524 and chamfer 1520, and $d_1$ is interference distance 1518, and $l_{c_1} \cos \theta$ is chamfer distance 1528. In another embodiment, angle θ is measured between side 1511 and chamfer 1520. In this embodiment, the relationship between length 1521, angle θ, and distance 1518 is defined as:

$$l_{c_1} \sin \theta \geq d_1 \qquad \text{Rel. 2}$$

where $l_{c_1} \sin \theta$ is chamfer distance 1528.

The relationship between length 1523, angle α, and interference distance 1519 is defined as:

$$l_{c_2} \cos \alpha \geq d_2 \qquad \text{Rel. 3}$$

where $l_{c_2}$ is length 1523, α is the angle between side 1525 and chamfer 1522, $d_2$ is interference distance 1519, and $l_{c_2} \cos \alpha$ is chamfer distance 1529. In another embodiment, angle α is measured between side 1514 and chamfer 1522. In this embodiment, length 1523 and angle α are defined as:

$$l_{c_2} \sin \alpha \geq d_2 \qquad \text{Rel. 4}$$

where $l_{c_2} \sin \alpha$ is chamfer distance 1529.

In another embodiment, part surface 1510 cannot move in direction 15274. In this embodiment, length 1523 and angle α are defined as:

$$l_{c_i} \cos \alpha \geq d_1 + d_2 \qquad \text{Rel. 5}$$

where $l_{c_i}$ is length 1523, $d_1$ is interference distance 1518, $d_2$ is interference distance 1519, and $l_{c_i} \cos \alpha$ is chamfer distance 1529.

In one embodiment, each of angles θ and α is 45°. In other embodiments, other angles and chamfer lengths are employed.

Returning to FIG. 15A, in step 1504, the set of parts at the interference point is modified with the chamfer having the chamfer angle and chamfer length determined in step 1503 to create a set of modified parts. In one embodiment, the chamfer is formed into the corners of the set of parts by machining the chamfer having the chamfer angle and chamfer length with a selected mill bit, thereby beveling the corners of the set of parts. Other means of modification known in the art may be employed.

In step 1505, the set of modified parts are tested. In one embodiment, the modified drawer slide assembly is operated to determine whether the modified parts interfere with each other at the interference point. In this embodiment, the set of modified parts are moved to contact each other to determine whether the set of modified parts bind or whether the set of modified parts move past each other, as previously described. In one embodiment, the drawer slide assembly is mounted in a testing jig known in the art to perform this step. Other means of testing known in the art may be employed.

In step 1506, whether the test of the set of modified parts is successful is determined, i.e., whether the modified parts move adjacent each other is determined. If the test is not successful, then method 1500 returns to step 1503. If the test is successful, then method 1500 proceeds to step 1507. In step 1507, whether all interference points in the set of interference points have been successfully modified is determined. If all interference points have not been successfully modified, then method 1500 proceeds to step 1508. In step 1508, method 1500 advances to the next interference point in set of interference points. If all interference points have been successfully modified, then method 1500 ends at step 1509.

Figure 16:
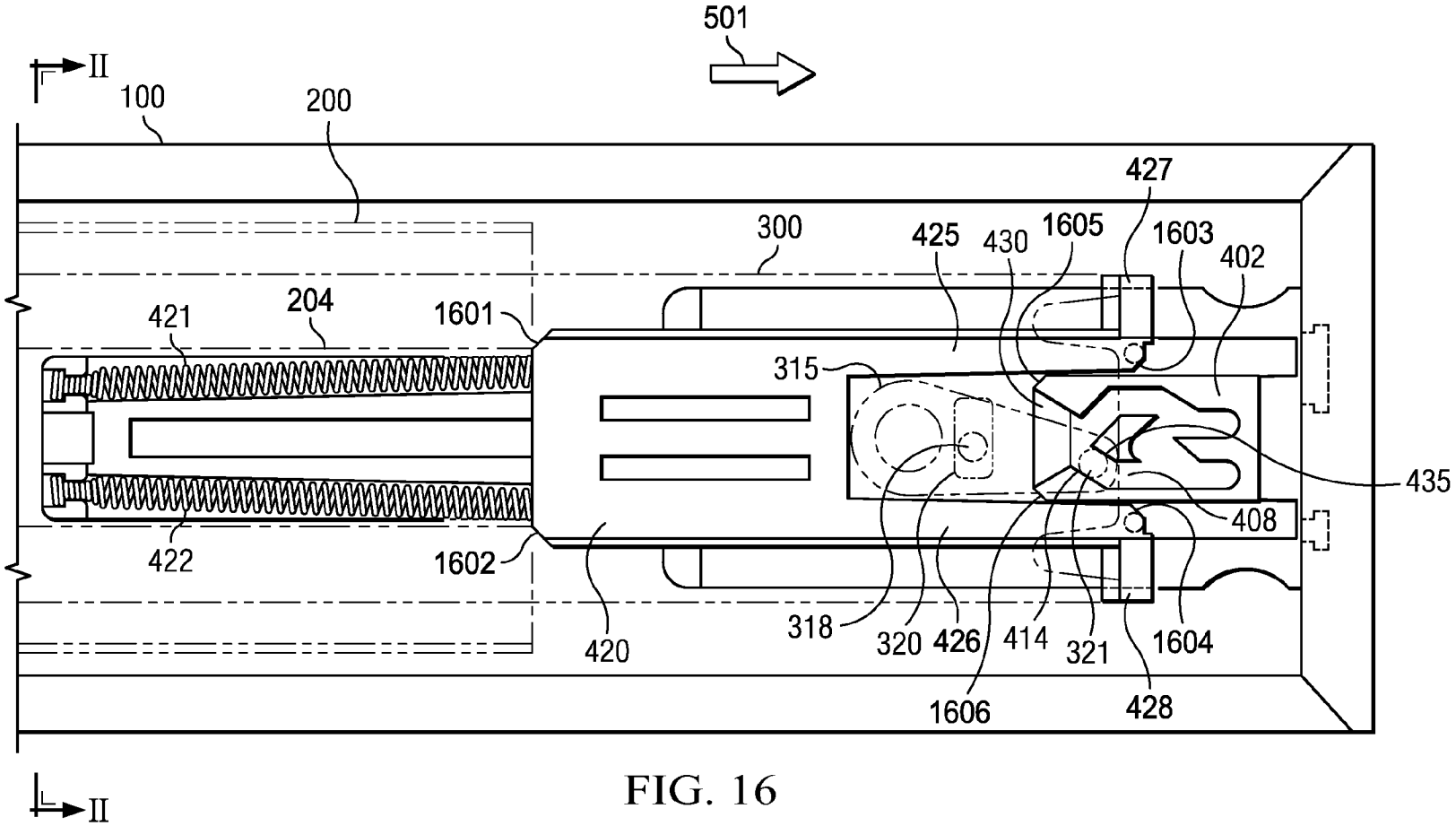
FIG. 16 is a side view of a modified drawer slide assembly of a preferred embodiment.

Referring to FIG. 16, carriage 420 has chamfers 1601 and 1602. Extension 425 has chamfer 1603 adjacent to bumper 427. Extension 426 has chamfer 1604 adjacent to bumper 428. Guide block 402 has chamfers 1605 and 1606 adjacent to ramp 430.

Chamfers 1601 and 1602 enable inner slide member 300 to move in direction 501 and engage with bumpers 427 and 428. Chamfers 1603, 1604, 1605, and 1606 enable carriage 420 to move in direction 501 adjacent guide block 402.

Figure 17:
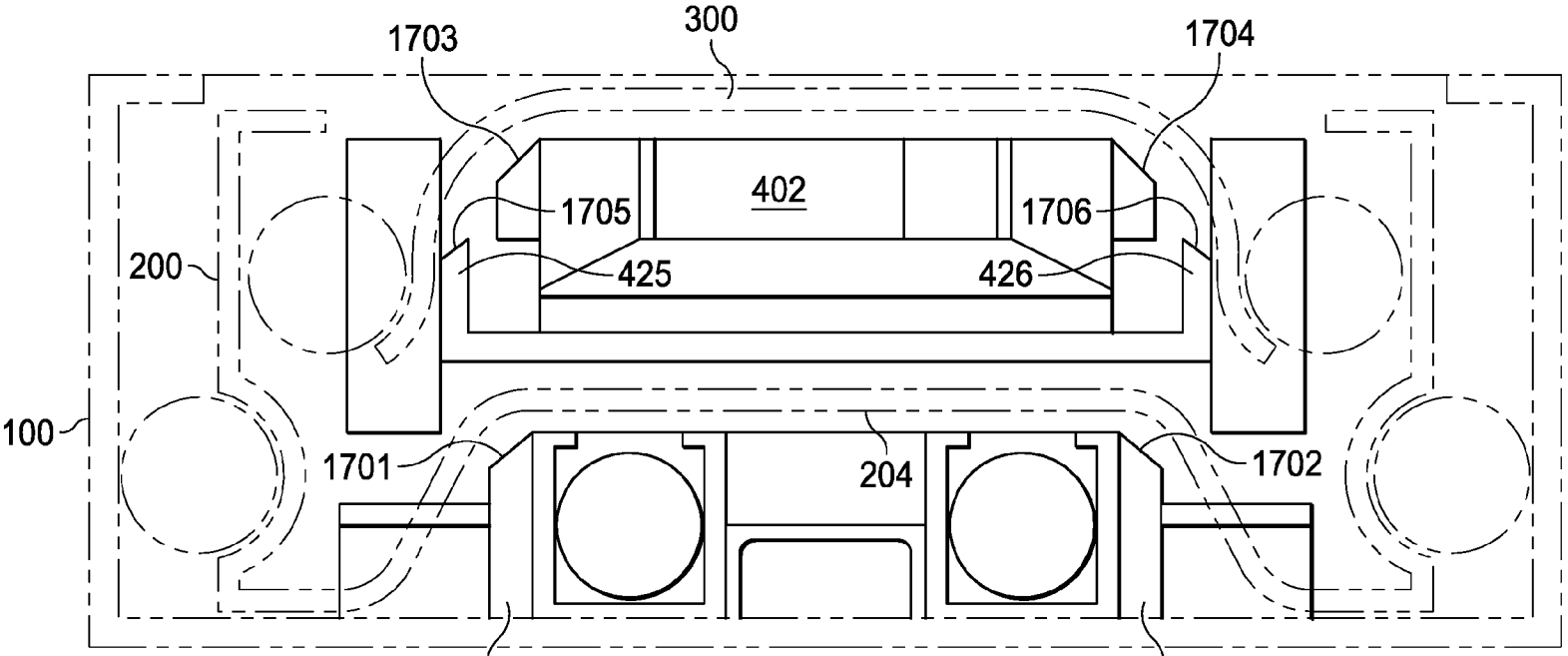
FIG. 17 is a partial section view of a modified drawer slide assembly of a preferred embodiment taken along line II-II of FIG. 16.

Referring to FIG. 17, spring hold 405 has chamfer 1701. Spring hold 406 has chamfer 1702. Guide block 402 has chamfers 1703 and 1704. Extension 425 has chamfer 1705. Extension 426 has chamfer 1706.

Chamfers 1701 and 1702 enable ridge 204 of intermediate slide member 200 to move unimpeded adjacent to spring holds 405 and 406.

Chamfers 1703, 1704, 1705, and 1706 enable inner slide member 300 to move unimpeded adjacent to guide block 402 and extensions 425 and 426.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A drawer slide assembly comprising:
an outer slide member;
an intermediate slide member telescopically mounted to the outer slide member;
an inner slide member telescopically mounted to the intermediate slide member;
a pressure release slide latch mechanism between the outer slide member and the inner slide member;
a set of chamfers integrally formed on the pressure release slide latch mechanism;
the pressure release slide latch mechanism further comprising:
a follower, having a pin extending from a body, pivotally connected to the inner slide member;
a track connected to the outer slide member;
a guide block adjacent the track and having a set of channels releasably engaged with the pin;
a carriage slidably engaged with the track; and,
a biasing means, creating a bias between the carriage and the track;
whereby the set of chamfers slidably engage the intermediate slide member and the inner slide member as the intermediate slide member and the inner slide member move to and from a locked position with respect to the outer slide member.

2. The drawer slide assembly of claim 1, wherein each chamfer of the set of chamfers further comprises:
a chamfer angle; and,
a chamfer length positioned at the chamfer angle.

3. The drawer slide assembly of claim 1, wherein the set of chamfers further comprises:
a first subset of chamfers integrally formed on the guide block;
a second subset of chamfers integrally formed on the carriage, adjacent the first subset of chamfers; and,
a third subset of chamfers integrally formed on the track, adjacent the intermediate slide member.

4. A drawer slide assembly comprising:
an outer slide member;
an intermediate slide member telescopically mounted to the outer slide member;
an inner slide member telescopically mounted to the intermediate slide member;
a follower pivotally connected to the inner slide member;
a track connected to the outer slide member;
a guide block adjacent the track and releasably engaged with the follower;
a carriage slidingly engaged with the track;
a biasing means, creating a bias between the carriage and the track;
a first set of chamfers integrally formed on the guide block;
a second set of chamfers integrally formed on the carriage;
a third set of chamfers integrally formed on the track;
whereby the first set of chamfers engage the second set of chamfers to maintain slidable engagement between the carriage and the guide block; and,
whereby the third set of chamfers engage the intermediate slide member to maintain slidable engagement between the intermediate slide member and the track.

5. The drawer slide assembly of claim 4, wherein the guide block further comprises:
a ramp;
a plurality of channels adjacent the ramp;
a plurality of redirecting surfaces adjacent the ramp and the plurality of channels;
a latch member adjacent the plurality of channels; and
wherein the plurality of redirecting surfaces and the latch member define the plurality of channels.

6. The drawer slide assembly of claim 5, further comprising a guide slot integrally formed in the inner slide member and wherein the follower further comprises:

a pin connected to the follower;

a guide post connected to the follower and extends into and slidingly engages with the guide slot;

whereby the guide slot and the guide post control a pivotal movement of the follower.

7. The drawer slide assembly of claim 6, wherein a set of dimensions of the guide slot limit an arcuate path through which the follower pivotally moves thereby enabling the pin to consistently engage the ramp.

8. The drawer slide assembly of claim 4, further comprising a fourth set of chamfers integrally formed on the carriage, opposite the second set of chamfers and slidably engaged with the inner slide member.

* * * * *